US005170706A

United States Patent [19]

Rodi et al.

[11] Patent Number: 5,170,706

[45] Date of Patent: Dec. 15, 1992

[54] SHEET FED ROTARY PRINTING PRESS

[75] Inventors: Anton Rodi, Leiman; Hermann Beisel, Walldorf; Bernd Müller, Nussloch, all of Fed. Rep. of Germany

[73] Assignee: Heidelberger Druckmaschinen Aktiengesellschaft, Heidelberg, Fed. Rep. of Germany

[21] Appl. No.: 693,861

[22] Filed: Apr. 29, 1991

[30] Foreign Application Priority Data

Apr. 27, 1990 [DE] Fed. Rep. of Germany ..... 4013464

[51] Int. Cl.[5] ..... B41F 7/26; B41F 7/40

[52] U.S. Cl. ..... 101/148; 101/350; 101/483

[58] Field of Search ..... 101/148, 147, 144, 145, 101/425, 423, 137, 350, 363, 364, 207, 208-210, 483, 211, 450.1

[56] References Cited

U.S. PATENT DOCUMENTS

| | | | |
|---|---|---|---|
| 3,264,981 | 8/1966 | Burger et al. | 101/144 |
| 3,731,624 | 5/1973 | Kancko et al. | 101/148 X |
| 4,095,525 | 6/1978 | Tsukada et al. | 101/465 |
| 4,440,081 | 4/1984 | Beisel . | |
| 4,475,460 | 10/1984 | Matsumoto | 101/451 |

FOREIGN PATENT DOCUMENTS

| | | | |
|---|---|---|---|
| 3832527 | 4/1989 | Fed. Rep. of Germany . | |
| 2569611 | 3/1986 | France | 101/148 |
| 432558 | 9/1967 | Switzerland . | |
| 2184982 | 7/1987 | United Kingdom | 101/148 |
| 2192835 | 1/1988 | United Kingdom . | |

*Primary Examiner*—J. Reed Fisher

*Attorney, Agent, or Firm*—Nils H. Ljungman and Associates

[57] ABSTRACT

A printing press having an inking unit and a wetting unit, which cooperate with a printing form by means of an inking roller and a wetting roller, having a control device for moving the wetting roller into an engagement or disengagement position with respect to the printing form. To expedite simple handling in the application of another substance onto the printing form, the wetting roller is supplied with the another substance by an apparatus provided therefore and moved into its engagement position with respect to the printing form by a control apparatus.

16 Claims, 4 Drawing Sheets

SHEET FED ROTARY PRINTING PRESS

The present invention relates to a sheet fed rotary printing press, the sheet fed rotary printing press including a plurality of printing stands, the printing stand including a plate cylinder for positioning a printing form to be used in a printing operation of the printing press, an ink reservoir for holding a supply of an ink for use in the printing operation of the printing stand, an inking device for transferring the ink from the ink reservoir to the printing form positioned on the plate cylinder during the printing operation of the printing stand, the inking device including a plurality of inking rollers positioned between the ink reservoir and the plate cylinder, the inking rollers having peripheral surfaces for transporting the ink thereon, and at least one of the plurality of inking rollers being in contacting engagement with the plate cylinder, ink metering means for transferring a metered flow of the ink from the ink reservoir to at least one of the peripheral surfaces of at least one of the plurality of inking rollers, the printing stand further including a wetting apparatus for applying a wetting agent to the printing form positioned on the plate cylinder, the wetting apparatus including a wetting agent reservoir for holding a supply of the wetting agent, and a wetting agent applicator device for transferring the wetting agent from the wetting agent reservoir to the printing form positioned on the plate cylinder, the wetting agent applicator device including at least one wetting roller having a peripheral surface for transporting the wetting agent thereon from the ink reservoir to the printing form positioned on the plate cylinder, and the printing stand additionally including an additional application apparatus for applying another substance to the surface of the printing form positioned on the plate cylinder, the another substance being distinct from the ink and the wetting agent.

The present invention also relates to a printing press, the printing press being equipped with an inking unit and a wetting unit, the inking unit and the wetting unit of the printing press cooperating with a printing form by means of inking rollers and wetting rollers, and the printing press also being equipped with a control apparatus for moving the wetting roller into an engaged or disengaged position with respect to the printing form.

When a printing operation is terminated (for example, with the overnight shutting down of an offset printing press), it is advantageous to protect the printing plate (or printing form) from environmental influences like, for example, corrosion. For this purpose, a so-called "gumming agent", which, for example, may contain gum arabic, is often employed. The gumming agent is applied to the printing plate by the operator of the printing press so as to form a protective layer thereon, which must be removed again by the operator before printing is resumed. The conventional procedure is time-consuming and, in view of the chemical agents normally used for removal of the protective layer, can be employed only in conjunction with adequate protective measures.

Therefore, one object of the present invention is the provision of a printing press of the aforementioned type, wherein the printing form can be gummed in an efficient manner which is not hazardous to health.

This and other objects of the invention are achieved in that, for the application of a gumming agent onto the printing form, a gumming fountain roller which dips into a trough of gumming agent is assigned to a wetting roller (or wetting agent roller) of the printing press, which applies a wetting agent to various rollers thereof. Thus, the application of the gumming agent is not accomplished manually, but automatically, by means of the wetting unit, especially the wetting roller. Therefore, removal of the printing form to be preserved, in particular a printing plate (e.g., an aluminum plate), from the offset printing press is no longer required. Thus, the wetting roller which supplies a wetting solution to the printing form in so-called "normal operation" assumes a double function, according to the invention, in that it also transfers the gumming agent to the printing form during the gumming operation. Thus, the gumming fountain roller transports the gumming agent out of a trough and transfers a gumming agent film onto the wetting roller which, in turn, transfers it to the printing form.

The wetting unit of an offset printing press may often be provided with a distributor cylinder which is machine driven and which cooperates with the wetting roller. The wetting roller is preferably often provided with an additional starting torque via the distributor cylinder, so that there is not any initial slip between the wetting roller and the printing form. By "printing form" is preferably meant the above-referred to printing plate, which is preferably clamped onto a plate cylinder provided as part of the offset printing press. In one embodiment of the invention, a distributor cylinder similar to that described above is preferably used for the transfer of the gumming agent onto the wetting roller, and the distributor cylinder thereby preferably functions as a connecting member between the gumming fountain roller and the wetting roller.

In an alternative embodiment, it is also possible to employ a spraying device which applies the gumming agent to the wetting roller and/or the distributor cylinder. That is, the gumming agent may also be sprayed onto the outer cylindrical surface of the wetting roller and/or the distributor cylinder.

The present invention also relates to a process for gumming a printing form of a printing press, especially an offset printing press, the printing press having an inking unit and a wetting unit, whereby the application of a gumming agent onto the printing form takes place via a wetting roller of the wetting unit of the printing press.

In order to avoid a situation wherein, on the one hand, too much wetting solution is mixed with the gumming agent and, on the other hand, little or no gumming agent gets into the wetting solution, the invention provides that, during the gumming process, the connection between the wetting roller and a wetting solution supply device (e.g., a wetting unit fountain roller) is interrupted or is set to supply a minimum amount of wetting solution to the wetting roller.

For removal of the gumming agent from the printing form, a washing process is preferably conducted, which takes place in the printing press. During the washing process, the wetting roller is preferably brought into a position of engagement with the plate cylinder, so that, when the printing plate (which is clamped on the plate cylinder) is washed, the washing fluid also reaches the wetting roller, and only residues of gumming agent which are there present are removed as well. Especially in this washing process, a separation from the wetting solution supply device is preferably created. That is, the washing fluid is prevented from entering the wetting solution fountain (e.g., the wetting solution reservoir) of the printing press. Furthermore, a distributor cylinder belonging to the wetting unit can be moved into a position of engagement with respect to the wetting roller during the washing process, so that the printing form and the wetting roller, as well as the distributor cylinder, can thereby be cleansed of gumming residues.

In summary, one aspect of the invention resides broadly in a printing stand for a sheet fed rotary printing press, the sheet fed rotary printing press comprising a plurality of printing stands, the printing stand comprising: a plate cylinder for positioning a printing form to be used in a printing operation of the printing stand; an ink reservoir for holding a supply of an ink for use in the printing operation of the printing stand; inking means for transferring the ink from the ink reservoir to the printing form positioned on the plate cylinder during the printing operation of the printing stand, the inking means comprising: a plurality of inking rollers positioned between the ink reservoir and the plate cylinder; each of the inking rollers having a peripheral surface for transporting the ink thereon, and at least one of the plurality of inking rollers being in contacting engagement with the plate cylinder; ink metering means for transferring a metered flow of the ink from the ink reservoir to at least one of the peripheral surfaces of at least one of the plurality of inking rollers; the printing stand further comprising wetting means for applying a wetting agent to the printing form positioned on the plate cylinder, the wetting means comprising: a wetting agent reservoir for holding a supply of the wetting agent; and wetting agent applicator means for transferring the wetting agent from the wetting agent reservoir to the printing form positioned on the plate cylinder; the wetting agent applicator means comprising at least one wetting roller having a peripheral surface for transporting the wetting agent thereon from the ink reservoir to the printing form positioned on the plate cylinder; and the printing stand additionally comprising additional application means for applying another substance to the surface of the printing form positioned on the plate cylinder, the another substance being distinct from the ink and the wetting agent.

BRIEF DESCRIPTION OF THE DRAWINGS

The invention will now be described by way of the following written description of a number of preferred embodiments, taken in conjunction with the accompanying drawings, wherein:

FIG. 5 is similar to FIG. 5 but shows a washing device as described herein.

DETAILED DESCRIPTION OF THE PREFERRED EMBODIMENTS

Figure 1:
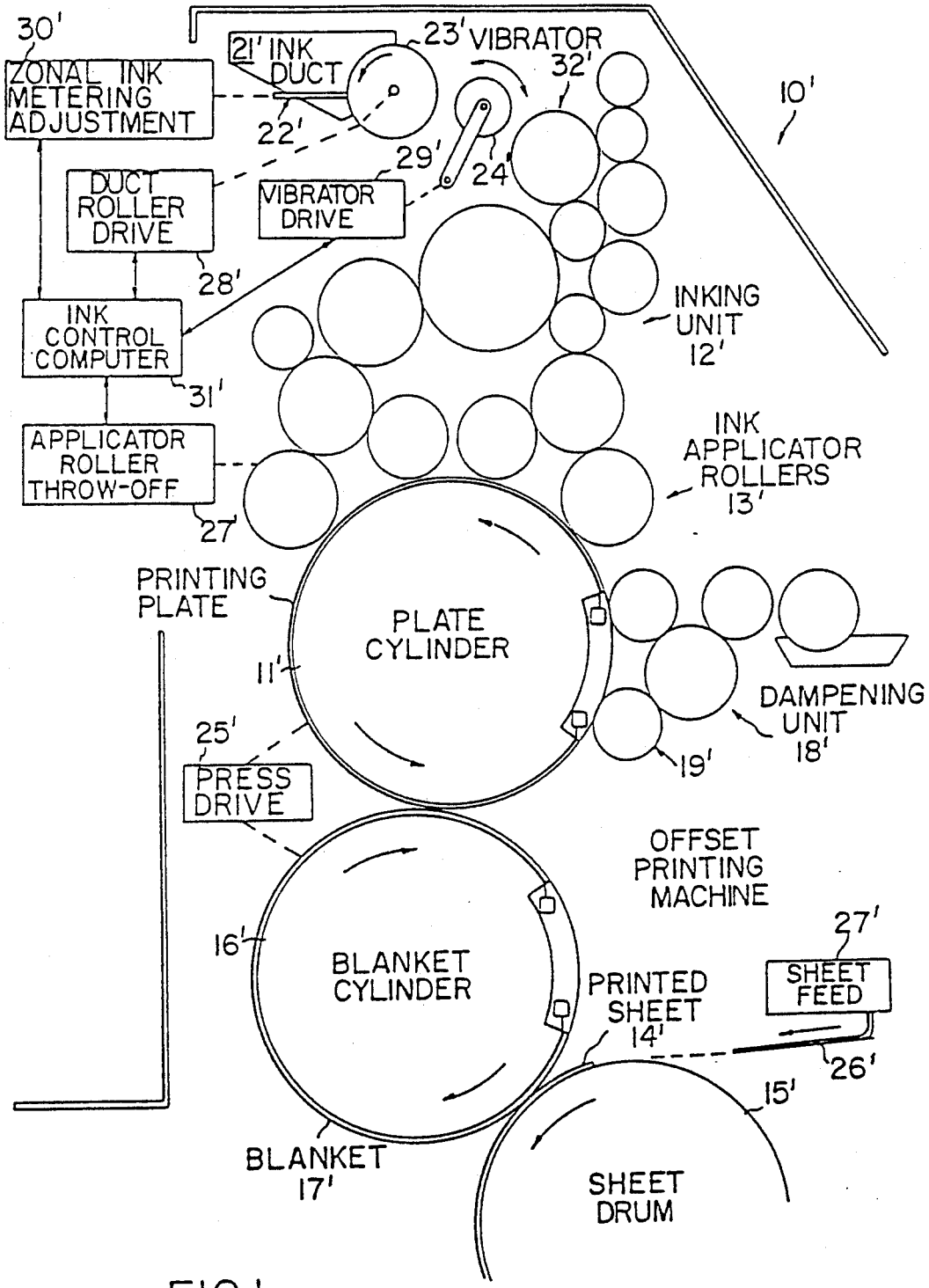
FIG. 1 is a general schematic representation of one printing stand of a rotary offset printing press, in cooperation with which the present invention provides an improved apparatus and method for the "gumming" of a printing form mounted thereon.

Referring first to FIG. 1, a rotary print stand 10', well known in the art, generally includes: a plate cylinder 11' having mounted thereon a printing plate D'; an inking unit 12' which includes ink applicator rollers 13' for applying to printing plate D' an ink profile of a single color printing ink (for example, black, cyan, magenta or yellow); a unit 18' having wetting applicator rollers 19' for transferring a wetting agent to printing plate D'; a blanket cylinder 16' carrying a rubber blanket 17' for receiving an ink impression from printing plate D'; and a sheet drum 15' for carrying a printed sheet 14' onto which the ink impression carried by blanket 17' is transferred.

It is particularly important that the ink be applied to printing plate D' in a precisely defined and controllable manner. That is, those areas of printing plate D' having a high density of printed content will require a greater ink flow during the printing process than those areas having a lower density of printed content. To this end, the printing stand 10' is typically provided with a means for zonally varying the ink application profile across the width of the printing stand 10'. For example, as shown in FIG. 1, printing stand 10' may be provided with an ink duct 21' which extends across its width. The zonal adjustment of the ink application profile is provided by a plurality of ink metering ducts 22' which may be controlled or adjusted by a zonal ink metering adjustment mechanism 30' under the control of a computer 31'.

A duct roller 23' is typically mounted adjacent to ink duct 21'. An ink duct of this type is further described in U.S. Pat. No. 3,978,788, issued Sept. 7, 1976.

Typically, the ink application profile which is set up on duct roller 23' is transferred into the inking unit 12' by means of a vibrator roller 24' which oscillates to successively pick up strips of ink from duct roller 23' and transfer them into inking unit 12', as for example, by contacting one of the rollers 32' thereof. The operation of such a vibrator roller 24' is more fully described in U.S. Pat. No. 3,908,545, issued Sept. 30, 1975.

Typically, the printing stand 10' will also include auxiliary mechanisms such as, for example, a duct roller drive 28', a vibrator roller drive 29', an applicator roller throw-off 27' for lifting the ink applicator rollers 13' off of the printing plate D', a press drive 25' and a sheet feed 27' for supplying the sheets to be printed 26' to sheet drive drum 15'.

Figure 2:
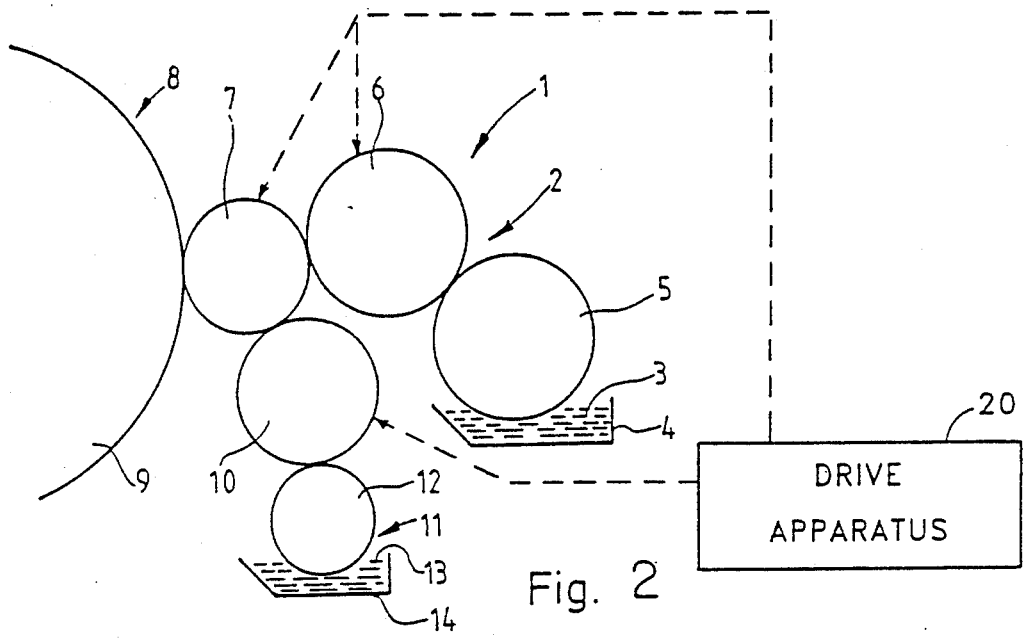
FIG. 2 is a schematic illustration of a roller arrangement for a wetting unit of an offset printing press, such as, for example, the rotary offset printing press illustrated in FIG. 1.

Referring now to FIG. 2, a roller arrangement for the wetting unit of an offset printing press is there shown schematically. For the sake of simplicity, various well known components of the offset printing press, such as the inking unit, the rubber blanket cylinder and the impression cylinder have not been shown in FIGS. 2-5, but are instead shown in FIG. 1.

FIG. 2 shows a wetting unit 1 having a wetting solution supply device 2 which includes a wetting solution trough 4 filled with a wetting solution 3. A wetting solution fountain roller 5, which is provided with a drive, has an outer cylindrical surface which dips into the wetting solution 3.

The wetting unit 1 further includes a metering roller 6, which is coupled to the wetting solution fountain roller 5, preferably via a conventional gear wheel drive unit of a type well known in the art. Cooperating with the metering roller 6, there is provided a wetting roller 7 which, when in the engaged position shown, contacts a printing form 8. The printing form 8 is preferably designed as a printing plate, and is preferably, as is the usual case, clamped onto the periphery of a plate cylinder 9.

There is also preferably further provided a driven distributor cylinder 10, which cooperates with the wetting roller 7. As shown in FIG. 2, the distributor roller 10 is preferably driven by a drive apparatus 20, which also preferably supplies driving power to the metering roller 6 and the wetting roller 7.

During a printing operation of the offset printing press, the wetting solution 3 is transferred as a thin film from the wetting solution fountain roller 5 to the metering roller 6 and from there, via the wetting roller 7, to the printing form 8. The wetting solution is metered, in a first way, by varying the pressure and, in a second way, by varying the slip between the metering roller 6 and the wetting roller 7, preferably via the rotational drive thereof by drive apparatus 20. The distributor cylinder 10 accomplishes the task of working wetting solution particles (e.g., usually water) into the ink present on the wetting roller and supplied thereto from an inking unit, the inking unit customarily including a number of inking rollers arranged in a "train". The ink derives from the printing form 8 and possibly also from an intermediate roller which is in an engagement position with respect to an inking unit roller and to the wetting roller 7. Thus, the intermediate roller forms a connecting link between the wetting unit 1 and the inking unit.

According to one aspect of the invention, there is provided a gumming device 11 which includes a gumming fountain roller 12, which dips into a trough 14 filled with a gumming agent 13.

As shown in FIG. 2, the roller arrangement is positioned such that the gumming agent is supplied to the printing form 8. Gumming agent 13, transported by the driven fountain roller 12, is transferred to the distributor cylinder 10 and, from there, to the wetting roller 7, and thereafter to the printing plate or form 8. Thus, the rollers belonging to the wetting unit 1, such as the wetting roller 7 and the distributor cylinder 10, are, according to one aspect of the invention, also used for another and heretofore unknown purpose, namely, the gumming of the printing form 8. Thus, the present invention makes possible the application of the gumming agent automatically to the printing form 8 as a protective layer against corrosion or the like.

In order to ensure that, during the application of the gumming agent, as little as possible of the wetting solution 3 is transferred to the wetting roller 7, to prevent dilution of the gumming agent 13, and also to ensure that the amount of gumming agent transferred to the wetting solution supply device 2 is minimized, the wetting solution fountain roller 5 and also, together therewith, the metering roller 6 are set to a very low rotational speed. For the same purpose, the rotational speed of the metering roller 6 is set by means of a wetting unit drive, in such a way that a minimum of slip exists between the wetting roller 7 and the metering roller 6.

Figure 3:
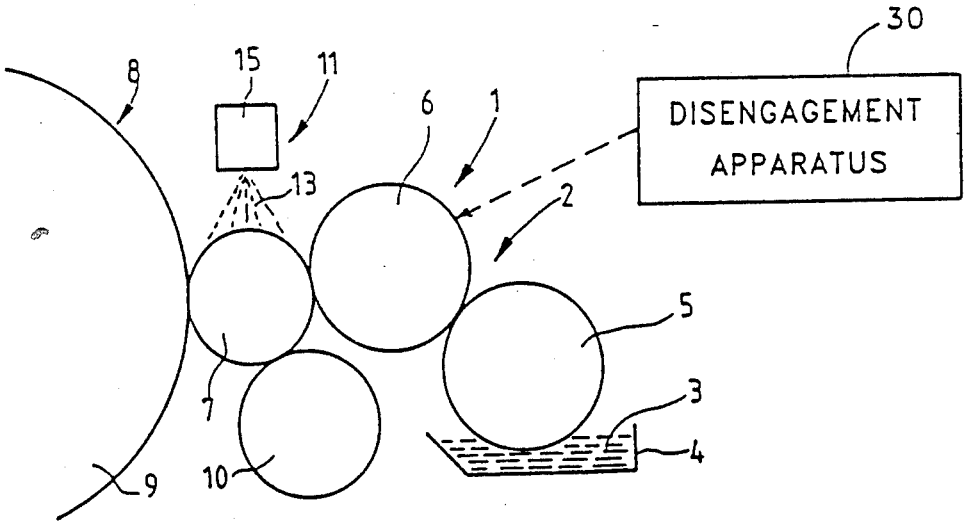
FIG. 3 is an illustration of another embodiment of such a roller arrangement.

FIG. 3 illustrates a further embodiment of the invention, which differs from the embodiment of FIG. 2 in that the gumming device 11 is designed as a spraying device 15 which sprays gumming agent onto the wetting roller 7. From there, the gumming agent 13 is then transferred to the printing form 8. Alternatively, it also is possible that the spraying device 15 be positioned such that its spraying jet hits the distributor cylinder 10, through which the gumming agent is thereby transferred to the wetting roller 7. In the embodiment shown in FIG. 3, the rotational speed and the slip of the metering roller 6, as mentioned above in connection with FIG. 2, are also set accordingly, in order to avoid a dilution of the gumming agent.

Alternatively to the embodiment of FIG. 2, it is possible to disengage the metering roller 6 from the wetting roller 7, by means of a separating device, so that, during the gumming operation, gumming agent is prevented from getting into the wetting solution supply device 2, and, similarly, wetting solution 3 is prevented from getting into the gumming agent 13. Such an embodiment, wherein the wetting unit roller arrangement is provided with a disengagement apparatus 30 for disengaging the metering roller 6 to from the wetting roller 7, is shown in the disengaged configuration in FIG. 4.

A disengagement between the wetting roller 7 and the metering roller 6, of course, can also be realized in the embodiment shown in FIG. 3, in order to also achieve the desired effect there.

Figure 4:
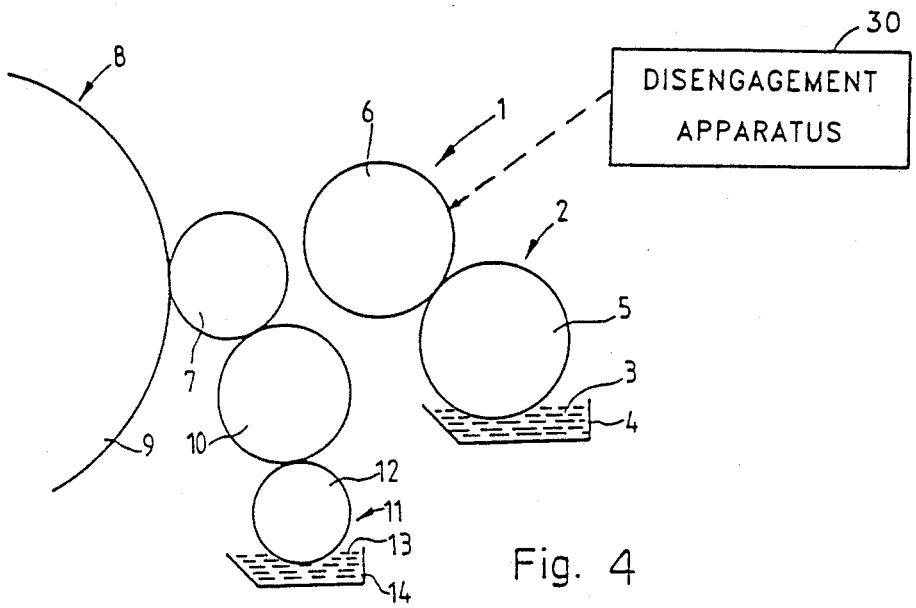
FIG. 4 is a view of the roller arrangement of FIG. 2, the roller arrangement also being provided with a disengagement apparatus, shown in a disengaged position.
Figure 5:
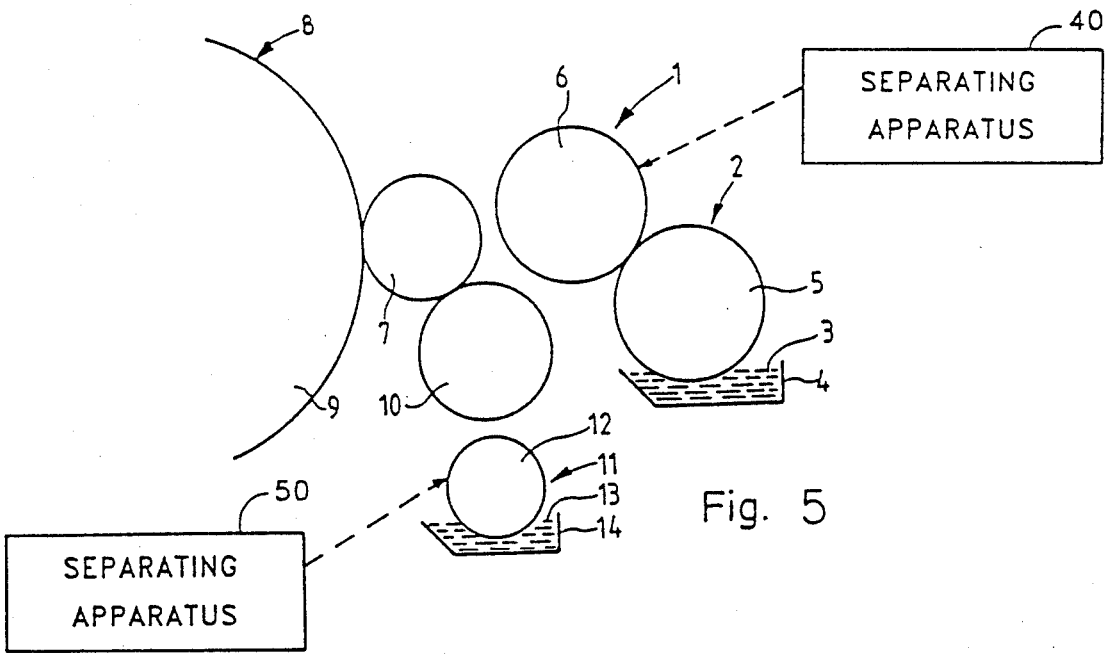
FIG. 5 is a view of the roller arrangement of the embodiment of FIG. 2, shown in a washing position.
Figure 5A:
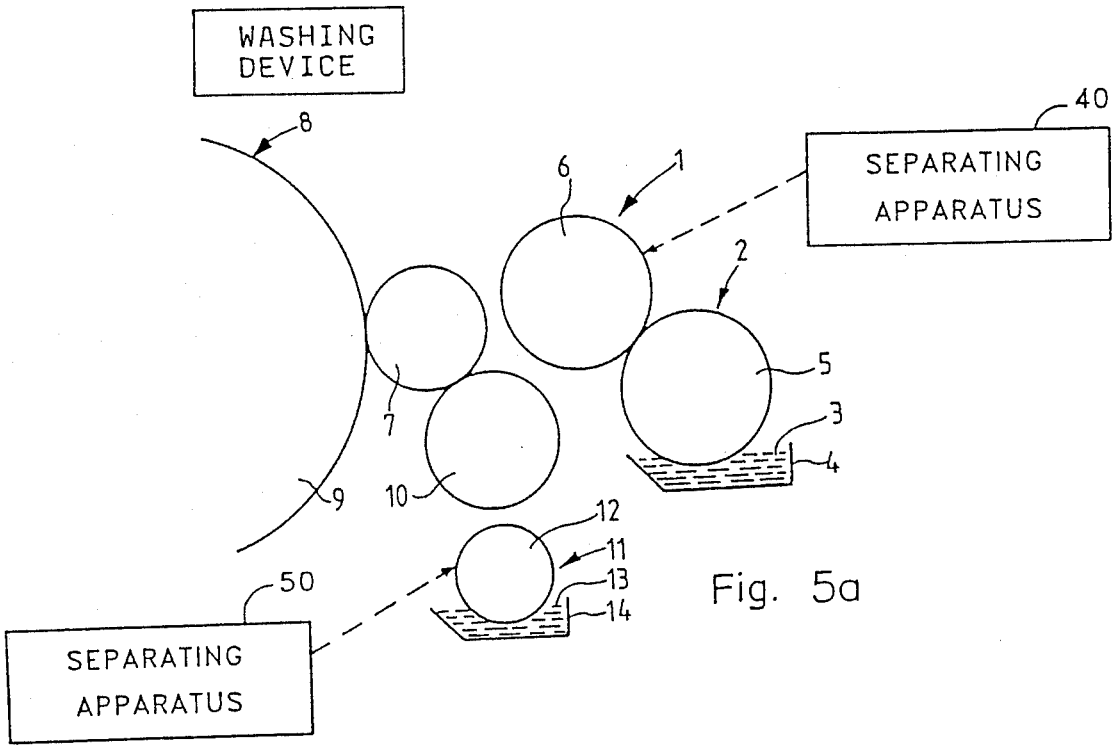

If the gumming agent is to be removed afterward from the printing form 8, it is preferably washed by means of a washing device. During this washing process, the wetting roller 7 takes its engagement position with respect to the plate cylinder 9 (as shown in FIG. 4). Thus, the washing fluid is also transferred to the wetting roller 7, and from there to the distributor cylinder 10 (if the latter is present). In order to prevent washing fluid from getting to the wetting solution supply device 2, and/or to the gumming device 11, a position of disengagement between the wetting roller 7 and the metering roller 8 is created by a separating apparatus 40, and the gumming device 11 is preferably displaced, by a similar separating apparatus 50 such that the distributor cylinder 10 is no longer in contact with the gumming fountain roller 12. In the described configuration of the roller arrangement, not only the printing form 8 is washed, but also the wetting roller 7 and the distributor cylinder 10 are cleansed from gumming residues. In a similar manner, the ink can be washed from the wetting roller after the printing process.

Accordingly, the present invention permits the automatic gumming of the printing form 8, as well as the cleansing of the printing form 8 and the parts of the offset printing press used in the gumming process. Moreover, the gumming fountain roller 12 does not act indirectly on the roller 7 via an interposed distributor cylinder 10, but takes a direct position on contact with the latter.

Mechanisms which can effect, selectively, a relative separation or a relative contacting between a pair of rollers or a set of rollers are well known in the art and are therefore not described in detail herein. For example, Published German Patent Application No. 15 61 100 discloses an inking unit for rotary printing presses having a controllable lifting mechanism for separating particular groups of rollers. In particular, there is disclosed a mechanism for the separation of a group of ink applicator rollers from a plate cylinder. Moreover, U.S. Pat. No. 3,869,983, issued to Garber and entitled "Variable Repeat-Length Web Press", discloses an apparatus for moving one roller toward and away from a second roller.

Control systems for controlling various aspects of the operation of an offset printing press, such as, for example, the timings and quantity of various fluid flows, the speed of rotation of various rollers and the timing and degree of separation between specific rollers in such printing presses are well known. For example, the publication entitled "Heidelberg CPC", published by Heidelberger Druckmaschinen AG, D-6900 Heidelberg (Publication No. HN2/43.e) describes such a control system for effecting these various functions and is well known in the art. One aspect of the control system described in this Heidelberg Publication is disclosed in German Published Patent Application No. 37 06 695.

Still further, Heidelberg Publication HN1/48.e published by Heidelberger Druckmaschinen AG, D-6900 Heidelberg describes another such control system, referred to in the art as the "CPTronic" system, which utilizes fully digitized technology for press control monitoring and diagnoses.

One feature of the invention resides broadly in a printing press having an inking unit and a wetting unit which cooperate with a printing form by means of inking and wetting rollers, and having a control device for moving the wetting roller into an engaged or disengaged position with respect to the printing form, characterized in that, for applying gumming onto the printing form 8, there is assigned to said wetting roller 7 a gumming fountain roller 12 fountain at least partly immersed into a trough 14 of gumming agent.

Another feature of the invention resides broadly in a printing press characterized in that, between the gumming fountain roller 12 and the wetting roller 7, there is arranged a distributor cylinder 10 belonging to said wetting unit 1.

A yet another feature of the invention resides broadly in a printing press having an inking unit and a wetting unit which cooperate with a printing form by means of inking and wetting rollers, and having a control device for moving the wetting roller into an engaged or disengaged position with respect to the printing form, characterized in that, for applying gumming onto said printing form 8 a gumming fountain roller 12 is assigned to said damper roller 7 and a spraying device 15 provides said wetting roller 7 and/or said distributor cylinder 10 with gumming agent 13.

Another yet further feature of the invention resides broadly in a method for gumming a printing form in a printing press having an inking unit and a wetting unit, characterized in that the feed of the gumming agent 13 to the printing form takes place via a wetting roller 7 of the wetting unit 1.

A further yet feature of the invention resides broadly in a method characterized in that, during the gumming process, the connection between the wetting roller and a wetting solution supply device 2 is interrupted or set to a minimum amount of wetting solution supply.

A further feature of the invention resides broadly in a method characterized in that, in the washing process of the clamped-on, preferably gummed printing plate, the wetting roller 7 takes its engagement position with respect to the plate cylinder 9 and that there is brought about a separation from the wetting solution supply device 2.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A printing stand for a sheet fed rotary printing press, said printing stand comprising:

a plate cylinder for positioning a printing form to be used in a printing operation of said printing stand;

an ink reservoir for holding a supply of an ink for use in the printing operation of said printing stand;

inking means for transferring the ink from said ink reservoir to the printing form positioned on said plate cylinder during the printing operation of said printing stand, said inking means comprising:

a plurality of inking rollers positioned between said ink reservoir and said plate cylinder;

each of said inking rollers having a peripheral surface for transporting the ink thereon, and at least one of said plurality of inking rollers being in contacting engagement with said plate cylinder;

ink metering means for transferring a metered flow of the ink from said ink reservoir to at least one of said peripheral surfaces of at least one of said plurality of inking rollers;

said printing stand further comprising wetting means for applying a wetting agent to the printing form positioned on said plate cylinder, said wetting means comprising:

a wetting agent reservoir for holding a supply of the wetting agent; and wetting agent applicator means for transferring the wetting agent from the wetting agent reservoir to the printing form positioned on said plate cylinder;

said wetting agent applicator means comprising at least one wetting roller having a peripheral surface for transporting the wetting agent thereon from said wetting agent reservoir to the printing form positioned on said plate cylinder, and an additional roller interposed between said wetting agent reservoir and said at least one wetting roller, said additional roller having a peripheral surface in contact with said peripheral surface of said at least one wetting roller, and said peripheral surface of said at least one wetting roller being in contact with the printing form positioned on said plate cylinder;

and said printing stand additionally comprising gumming agent application means for applying a gumming agent to the surface of the printing form positioned on said plate cylinder, the gumming agent being distinct from the ink and the wetting agent;

said gumming agent application means comprising:

a gumming agent reservoir configured to hold a supply of the gumming agent; and transfer means for transferring the gumming agent from said gumming agent reservoir to said peripheral surface of said at least one wetting roller that is in contact with the printing form positioned on said plate cylinder;

said printing stand further comprising:

disengagement means for breaking said contact between said peripheral surface of said additional roller and said peripheral surface of said at least one wetting roller;

separation means for blocking the flow of the gumming agent froms said gumming agent reservoir to said peripheral surface of said at least one wetting roller;

washing means for supplying a flow of a washing fluid to the printing form positioned on said plate cylinder;

means for actuating, during the flow of the washing fluid to the printing form positioned on said plate cylinder, said disengagement means to thereby break said contact between said peripheral surface of said at least one wetting roller;

means for actuating, during the flow of the washing fluid to the printing form positioned on said plate cylinder, said separation means to thereby block the flow of the gumming agent form said gumming agent reservoir to said peripheral of said at least one wetting roller; and means for actuating, during the flow of the gumming agent from said additional reservoir to the printing form mounted on said printing cylinder, said disengagement means to thereby break contact between said peripheral surface of said additional roller and said peripheral surface of said at least one wetting roller;

whereby, during the flow of the washing fluid to the printing form positioned on said plate cylinder, the washing fluid is effectively prevented from entering both of said wetting agent reservoir and said gumming agent reservoir; and whereby, during the flow of the gumming agent from the gumming agent reservoir to the printing form positioned on said plate cylinder, the gumming agent is effectively prevented for entering said wetting agent reservoir.

2. The printing stand according to claim 1, wherein said gumming agent applicator means comprises spray means for applying the gumming agent, in the form of a spray, to the peripheral surface of the at least one wetting roller.

3. The printing stand according to claim 2, wherein said gumming agent applicator means additionally comprises a distributor roller, said distributor roller being in contact with said at least one wetting roller of said printing stand.

4. The printing stand according to claim 1, wherein said transfer means of said gumming agent application means comprises:

a gumming agent fountain roller, said gumming agent fountain roller being in contact with said supply of the gumming agent contained being in contact with said supply of the gumming agent contained in said gumming agent reservoir; and a distributor cylinder interposed between said gumming agent fountain roller and said at least one wetting roller;

and wherein said separation means comprises means for breaking contact between said gumming agent fountain roller and said distributor roller while maintaining said distributor roller and said at least one wetting roller in contact.

5. The printing stand according to claim 4, wherein said additional roller comprises a metering roller, and wherein said printing stand additionally comprises means for metering the flow of the wetting agent between said metering roller and said at least one wetting roller.

6. The printing stand according to claim 5, wherein said means for metering comprises means for varying the contact pressure between said metering roller and said at least one wetting roller, and means for varying the amount of slip between said peripheral surface of said metering roller and said peripheral surface of said at least one wetting roller.

7. A gumming apparatus for a printing stand which includes a plate cylinder for receiving the mounting thereon of a printing form, an ink reservoir for holding a supply of an ink for employment in a printing operation of the printing stand, ink applicator means for transferring the ink from the ink reservoir to a printing form mounted on the plate cylinder, a wetting agent reservoir for holding a supply of a wetting agent for employment in the printing operation of the printing stand, and wetting agent applicator means for transferring the wetting agent from the wetting agent reservoir to the printing form mounted on the plate cylinder, the wetting agent applicator means including at least one wetting roller having a peripheral surface for transporting the wetting agent thereon, said gumming apparatus being for the application of a protective later of a gumming agent to the printing form mounted on the plate cylinder, said gumming apparatus comprising:

a gumming agent reservoir configured to hold a supply of the gumming agent; and gumming agent applicator means for transferring a flow of the gumming agent from said gumming agent reservoir to said peripheral surface of said at least one wetting roller;

said gumming agent applicator means comprising a gumming fountain roller, said gumming agent fountain roller having a peripheral surface for the transport thereon of the gumming agent;

wherein said gumming agent fountain roller is at least partially submerged into the supply of the gumming agent held in said gumming agent reservoir;

wherein said gumming agent applicator means additionally comprises a gumming agent distributor roller, said gumming agent distributor roller being in contact with said at least one wetting roller of the printing stand;

wherein said gumming agent distributor roller is interposed between and in contact with both of said gumming agent fountain roller and said at least one wetting roller;

said gumming apparatus further comprising separating means for separating and breaking contact between said gumming agent distributor roller and at least one of said gumming agent fountain roller and said at least one wetting roller;

wherein the printing stand additionally includes wetting agent metering means for metering the transfer of the wetting agent between said wetting agent reservoir and said at least one wetting roller, said wetting agent metering means comprising at least one wetting agent metering roller, said at least one wetting agent metering roller being interposed between and in contact with both of said wetting agent fountain roller and said at least one wetting roller, and wherein said gumming apparatus additionally comprises disengagement means for disengaging and breaking contact between said at least one wetting agent metering roller and at least one of said wetting agent fountain roller and said at least one wetting roller.

8. A process for applying a protective coating of a gumming agent to a printing form mounted in a printing stand, the printing stand including a plate cylinder for receiving the mounting thereon of the printing form, an ink reservoir for holding a supply of an ink for employment in a printing operation of the printing stand, ink applicator means for transferring the ink from the ink reservoir to the printing form mounted on the plate cylinder, a wetting agent reservoir for holding a supply of a wetting agent for employment in the printing operation of the printing stand, and wetting agent applicator means for transferring the wetting agent from the wetting agent reservoir to the printing form mounted on the plate cylinder, the wetting agent applicator means including at least one wetting roller having a peripheral surface for transporting the wetting agent thereon, said process comprising the steps of:

providing a gumming agent reservoir, separate and distinct from said wetting agent reservoir, configured to hold a supply of the gumming agent;

performing a first printing job with the printing stand utilizing a first printing form mounted on said plate cylinder;

terminating said first printing job and maintaining said first printing form mounted on said plate cylinder;

transferring the gumming agent from said gumming agent reservoir to the peripheral surface of the at least one wetting roller and, thereafter, to the first printing form mounted on the plate cylinder;

terminating the operation of said printing stand for a period of time and allowing said gumming agent to remain on said first printing form during said period of time; and resuming the operation of said printing stand.

9. The process according to claim 8, said process additionally comprising the further step of, during said step of transferring of the gumming agent from said gumming agent reservoir to the printing form mounted on the plate cylinder, preventing the transfer of the wetting agent from the wetting agent reservoir to the printing form mounted on the plate cylinder.

10. The process according to claim 9, said process further comprising the additionally step of washing the printing form mounted on the plate cylinder, said washing of the printing form mounted on the plate cylinder comprising the steps of:

applying a washing solution to the printing form; and during the application of the washing solution to the printing form, preventing any fluid flow between the printing form and the wetting agent reservoir.

11. The process according to claim 10, said process comprising the additional step of, during the application of the washing solution to the printing form, preventing any fluid flow between the printing form and said gumming agent reservoir.

12. The process according to claim 9, said process further comprising the additional steps of:

during said transfer of gumming agent to the printing form, effectively preventing the gumming agent from entering said wetting agent reservoir;

washing the gumming agent from the printing form mounted on said plate cylinder by applying a washing solution to the printing form;

during said washing step, maintaining said at least one wetting roller in contact with the printing form mounted on said plate cylinder; and during said washing step, effectively preventing any of said washing solution from entering both of said wetting agent reservoir and said gumming agent reservoir.

13. The process according to claim 11, said process further comprising the additional steps of:

during said application of the washing fluid to the printing form, maintaining said ate least one wetting roller in contact with said printing form, whereby the washing fluid is transferred from said printing form to said at least one wetting roller.

14. The process according to claim 13, said process further comprising the additional steps of:

providing wetting agent metering means for metering the transfer of the wetting agent between said wetting agent reservoir and said at least one wetting roller, said wetting agent metering means comprising at least one wetting roller, said wetting agent metering means comprising agent metering roller being interposed between and in contact with both of said wetting agent fountain roller and said at least one wetting roller; and during said transfer of the gumming agent from said gumming agent reservoir to the first printing form mounted on said plate cylinder, separating said wetting agent metering roller from said at least one wetting roller.

15. The process according to claim 14, said process further comprising the additional steps of:

during the application of the washing solution to the printing form, separating said wetting agent metering roller from said at least one wetting roller.

16. The process according to claim 15, said process further comprising the additional steps of:

providing a gumming fountain roller contacting the supply of gumming agent held in said gumming agent reservoir;

providing a gumming agent distributor roller, said gumming agent distributor roller being interposed between and in contact with both of said gumming fountain roller and said at least one wetting roller, and during the application of the washing solution to the printing form, separating said gumming agent distributor roller from said at least one wetting roller.

* * * * *

UNITED STATES PATENT AND TRADEMARK OFFICE

CERTIFICATE OF CORRECTION

PATENT NO. : 5,170,706

DATED : December 15, 1992

INVENTOR(S) : Anton RODI, Herman BEISEL and Bernd MÜLLER

It is certified that error appears in the above-indentified patent and that said Letters Patent is hereby corrected as shown below:

In column 3, line 67, after 'FIG.' (first occurrence), delete "5" and insert --5a--.

In column 8, line 66, Claim 1, after 'agent', (first occurrence) delete "froms" and insert --from--.

In column 9, line 12, Claim 1, after 'agent', delete "form" and insert --from--.

In column 9, line 13, Claim 1, after 'peripheral', insert --surface--.

In column 9, line 30, Claim 1, after 'prevented', delete "for" and insert --from--.

In column 9, line 47, Claim 4, after 'contained', delete "being in contact with".

UNITED STATES PATENT AND TRADEMARK OFFICE

CERTIFICATE OF CORRECTION

PATENT NO. : 5,170,706

DATED : December 15, 1992

INVENTOR(S) : Anton RODI, Hermann BEISEL and Bernd MÜLLER

It is certified that error appears in the above-indentified patent and that said Letters Patent is hereby corrected as shown below:

In column 9, line 48, Claim 4, before 'in', delete "said supply of the gumming agent contained".

In column 11, line 39, Claim 10, after 'the' (first occurrence), delete "additionally" and insert --additional--.

In column 12, line 17, Claim 13, after 'said', delete "ate" and insert --at--.

In column 12, lines 27 and 28, Claim 14, after 'wetting', (first occurrence) delete "roller, said wetting agent metering means comprising" and insert --agent metering roller, said at least one wetting--.

Signed and Sealed this

Nineteenth Day of July, 1994

*Attest:*

*Attesting Officer*

Bruce Lehman

BRUCE LEHMAN

*Commissioner of Patents and Trademarks*